US008859878B2

(12) United States Patent
Fujiwara et al.

(10) Patent No.: US 8,859,878 B2
(45) Date of Patent: Oct. 14, 2014

(54) METHOD AND DEVICE FOR IDENTIFYING HALF POINT OF PEDAL ON KEYBOARD MUSICAL INSTRUMENT

(71) Applicant: Yamaha Corporation, Hamamatsu (JP)

(72) Inventors: Yuji Fujiwara, Hamamatsu (JP); Yasuhiko Oba, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 14/139,919

(22) Filed: Dec. 24, 2013

(65) Prior Publication Data

US 2014/0182444 A1 Jul. 3, 2014

(30) Foreign Application Priority Data

Dec. 28, 2012 (JP) ..... 2012-287149

(51) Int. Cl.
*G10H 1/32* (2006.01)
*G10H 3/00* (2006.01)
*G10C 3/26* (2006.01)

(52) U.S. Cl.
CPC ..... *G10C 3/26* (2013.01)
USPC ..... 84/746

(58) Field of Classification Search
CPC ..... G10F 1/02; G10F 5/00; G10C 3/26; G10H 2230/011
USPC ..... 84/746, 13, 19, 21
See application file for complete search history.

(56) References Cited

U.S. PATENT DOCUMENTS 5,131,306 A 7/1992 Yamamoto
5,523,522 A * 6/1996 Koseki et al. ..... 84/21
5,714,702 A * 2/1998 Ishii ..... 84/462
5,905,220 A * 5/1999 Lee et al. ..... 84/461
5,936,172 A * 8/1999 de La Rochefordiere ..... 84/217
7,332,670 B2 * 2/2008 Fujiwara et al. ..... 84/744
7,943,843 B2 * 5/2011 Komatsu ..... 84/615
2006/0021488 A1 * 2/2006 Fujiwara et al. ..... 84/13
2007/0256550 A1 11/2007 Muramatsu
2013/0180377 A1 * 7/2013 Oba et al. ..... 84/229

FOREIGN PATENT DOCUMENTS

JP 2606616 B2 5/1997
JP 4524798 B2 8/2010

OTHER PUBLICATIONS

Extended European Search Report for EP13199334.7, dated Apr. 10, 2014.

* cited by examiner

*Primary Examiner* — Jeffrey Donels
(74) *Attorney, Agent, or Firm* — Rossi, Kimms & McDowell LLP

(57) ABSTRACT

A key depression (i.e., string striking) is performed while a pedal is kept at a set non-key-depressed-state corresponding position (a rest position of a hammer). A string striking velocity immediately before string striking and a string releasing velocity immediately after the string striking are detected, and a coefficient of rebound is calculated on the basis of the detected velocities and stored in association with the current value of the rest position of the hammer. Similar operations are repetitively performed with individual ones of different rest positions of the hammer, wherein each of the different rest positions of the hammer corresponding to each of a plurality of stroke positions within one stroke of the pedal. Thus, a distribution curve of the coefficients of rebound detected in association with the plurality of stroke positions is obtained and a half point of the pedal is identified based on the distribution curve.

15 Claims, 7 Drawing Sheets

| NOTE | PIANO KEY NO. | START POINT | END POINT | HALF POINT |
|---|---|---|---|---|
| 21 | 1 | xsf21 | xsc21 | xsh21 |
| 22 | 2 | xsf22 | xsc21 | xsh22 |
| 23 | 3 | xsf23 | xsc23 | xsh23 |
| : | : | : | : | : |
| 89 | 69 | xsf107 | xsc107 | xsh107 |
| 108 | 88 | xsf108 | xsc108 | xsh108 |

FIG. 7A

| RANGE | NUMBER OF WIRE MEMBERS | START POINT | END POINT | HALF POINT |
|---|---|---|---|---|
| 1 | 1 | xs1f | xs1c | xs1h |
| 2 | 2 | xs2f | xs2c | xs2h |
| 3 | 3 | xs3f | xs3c | xs3h |

FIG. 7B

METHOD AND DEVICE FOR IDENTIFYING HALF POINT OF PEDAL ON KEYBOARD MUSICAL INSTRUMENT

BACKGROUND

The present invention relates to a method and device for identifying a half point of a pedal on a keyboard musical instrument, and a non-transitory, computer-readable storage medium storing therein a program for identifying such a half point. The present invention also relates to a method and device for reproducing a half point performance of a pedal on a keyboard musical instrument, and a non-transitory, computer-readable storage medium storing therein a program for reproducing such a half point performance.

Heretofore, keyboard musical instruments have been known which can generate sounds by striking strings (string sets) via hammers as in an acoustic piano and which include depressable pedals. Among such pedals is one which is designed to make variable non-key-depressed-state corresponding positions (i.e., rest positions) that are initial relative positions of hammers relative to string sets in a non-key-depressed state. Such a pedal is commonly called "shift pedal" in the grand piano or "soft pedal" in the upright pedal.

In the case of the grand piano, a key frame moves horizontally in a left-right direction relative to string sets, so that non-key-depressed-state corresponding positions (rest positions) of hammers too horizontally move in the left-right direction. In the grand piano, the number of component wire members (i.e., string elements) constituting the string set of each note differs depending on the pitch range which the string set belongs to that is, whereas the number is only one in a lowest pitch range, two wire members are placed in substantially parallel relation to each other in a low pitch range, and three wire members are placed in parallel in medium and higher pitch ranges. If positions at which the string sets are to be struck by the hammers (i.e., hammers' string-striking positions) are shifted in response to depression of the shift pedal, the number of wire members to be struck by each of the hammers changes in the pitch ranges other than the lowest pitch range. Also, in all of the pitch ranges, portions of the hammers actually contacting or abutting against the string sets are shifted in position horizontally.

Further, in the high pitch range, for example, whereas the number of wire members to be struck is "three" when the shift pedal is in a non-depressed state, the number of wire members to be struck is "two" when the shift pedal is in a completely depressed state. Further, in the low pitch range, whereas the number of wire members to be struck is "two" when the shift pedal is in the non-depressed state, the number of wire members to be struck is "one" when the shift pedal is in the completely depressed state. Such arrangements permit variations in sound color and volume.

Also known in the art is a performance expression effected by a human player depressing keys while depressing the shift pedal to a halfway point of a so-called pedal stroke from the non-depressed state or position to a completely-depressed state or position.

Further, a portion of a hammer felt which frequently strikes a string set tends to have a greater dent and greater hardness than the other portions. Thus, if the hammer strikes the string set with a horizontal positional shift relative to the string set, it would strike the string set by its portion differing in dent size and hardness from the frequently-striking portion, thereby resulting in variations in sound color and volume. Therefore, when a key is depressed with the shift pedal depressed to a halfway point, the portion of the hammer striking the string set varies to thereby achieve variations of tone characteristics. Further, in that case, a state where a single wire member located at an end of the string set is struck incompletely can also be realized. In this way, desired subtle variations in sound color and volume can be expressed by a depressing state of the shift pedal.

In the depressing stroke, from the non-depressed position to the completely-depressed position, of the shift pedal, there is a region or point where tone characteristics produced by string striking change. Such a region or point will hereinafter be referred to as a "half region" or "half point" of the shift pedal.

Furthermore, among the conventionally-known keyboard musical instruments is one which can execute an automatic performance, including loud pedal (damper pedal) operations, by supplying a driving electric current to a solenoid coil to thereby drive the loud pedal. In an automatic performance, it is desirable that appropriate pedal operation control corresponding to a half pedal region of the loud pedal be performed in order to enhance reproducibility of the performance. With the shift pedal too, reproducibility of a performance in an automatic performance can be enhanced if appropriate reproduction of the half region or half point can be realized.

However, static and dynamic characteristics of the pedals are characteristics unique to each keyboard musical instrument and differ from one keyboard musical instrument to another depending also on mounted states and conditions of the pedals. Thus, it is difficult to accurately identify a half point in the half region.

Methods for identifying a half point of the loud pedal on the basis of load information of the pedal are disclosed in Japanese Patent Nos. 2606616 and 4524798. However, unlike with the loud pedal to which a damper lifting load starts to be applied even in the middle of a pedal depression operation, it is difficult to identify a half point of the shift pedal on the basis of a load on the shift pedal. Therefore, in a case where tone characteristics of the grand piano are to be controlled, it was impossible to control tone characteristics by use of a half point of the shift pedal. For this reason, it has been desirable to establish a method for accurately identifying a half point of the shift pedal.

Generally, in the case of the upright piano, on the other hand, a distance, to the string set, of the hammer in the non-key-depressed-state corresponding position (rest position) changes in response to depression of the soft pedal. Thus, even when the key is depressed at a same velocity, changing the depressing state of the soft pedal can vary a string striking velocity and hence sound volume. With the uptight-type piano too, it is conceivable to employ a construction where there exists a point at which tone characteristics change. In such a case too, it is desirable to establish a method for accurately identifying a half point of the soft pedal.

SUMMARY OF THE INVENTION

In view of the foregoing prior art problems, it is an object of the present invention to provide an improved technique for appropriately identifying a half point of a pedal, such as a shift pedal or soft pedal, on a keyboard musical instrument. It is another object of the present invention to provide an improved method and device for appropriately reproducing a half point performance of the pedal by use of the identified half point.

In order to accomplish the above-mentioned object, the present invention provides an improved method for identifying a half point of a pedal on a keyboard musical instrument, the keyboard musical instrument including: a key; a hammer constructed to make a pivotal motion in response to an operation of the key; and a string set comprised of at least one wire member and constructed to be struck by the hammer and the pedal constructed to make a stroke motion in response to a depressing operation performed thereon, the pedal being constructed to change a rest position of the hammer relative to the string set in accordance with a stroke position thereof, the method comprising: a step of striking the string set by the hammer in association with individual ones of different rest positions of the hammer, each of the different rest positions of the hammer corresponding to each of a plurality of stroke positions within one stroke of the pedal; a detection step of, in response to the hammer striking the string set, detecting data indicative of at least one of behavior of the hammer and reaction of the string set, the detection step detecting the data in association with the individual ones of the plurality of stroke positions; and an identification step of identifying a half point of the pedal on the basis of the data detected by the detection step in association with the plurality of stroke positions.

The present invention constructed in the aforementioned manner can appropriately identify a half point of the pedal, such as a shift pedal or soft pedal, constructed to relatively displace the rest position of the hammer. The half point identified in this manner can be advantageously used in various scenes. For example, information of the identified half point is preferably stored in a memory, so that, when an automatic performance of the keyboard musical instrument is to be executed, the pedal can be automatically operated in accordance with the stored information of the identified half point so that an automatic performance involving half pedal operations can be executed with ease.

Preferably, the identification step identifies a half region, indicative of a transient variation characteristic, on the basis of a distribution curve of the data detected in association with the plurality of stroke positions and identifies the half point in the identified half region.

Preferably, the detection step detects a string striking velocity of the hammer and a string releasing velocity of the hammer after striking of the string set and calculates, as a coefficient of rebound indicative of the reaction of the string set, a ratio of the string striking velocity to the string releasing velocity.

Preferably, the string set comprises at least two wire members and is constructed so as not to abut against an outermost wire member of the at least two wire members of the string set in response to depression of the key in a completely-depressed state of the pedal, and the detection step detects vibrations of the outermost wire member as data indicative of the reaction of the string set.

In order to accomplish the above-mentioned object, the present invention also provides an improved apparatus for identifying a half point of a pedal on a keyboard musical instrument, the keyboard musical instrument including: a key; a hammer constructed to make a pivotal motion in response to an operation of the key; and a string set comprised of at least one wire member and constructed to be struck by the hammer; and the pedal configured to make a stroke motion in response to a depressing operation performed thereon, the pedal being constructed to change a rest position of the hammer relative to the string set in accordance with a stroke position thereof, the apparatus comprising: a sensor adapted to detect a plurality of stroke positions within one stroke of the pedal; a detector adapted to, in response to the hammer striking the string set, detect data indicative of at least one of behavior of the hammer and reaction of the string set; and a processor. The processor is adapted to: for each of the plurality of stroke positions within one stroke of the pedal and in response to the hammer striking the string set from the rest position corresponding to the stroke position, detect the at least one of behavior of the hammer and reaction of the string set; and identify a half point of the pedal on the basis of the data detected in association with the plurality of stroke positions.

Also provided by the present invention is an improved method for reproducing a half point performance of a pedal on a keyboard musical instrument, the keyboard musical instrument a key; a hammer constructed to make a pivotal motion in response to an operation of the key; and a string set comprised of at least one wire member and constructed to be struck by the hammer; and the pedal configured to make a stroke motion in response to a depressing operation performed thereon, the pedal being constructed to change a rest position of the hammer relative to the string set in accordance with a stroke position thereof, the method comprising: a step of providing a memory storing therein data identifying a half point of the pedal; a step of striking the string set by the hammer in accordance with automatic performance data including at least data for driving the key; and a driving step of automatically driving the pedal in accordance with data included in the automatic performance data and instructing behavior of the pedal, the driving step positioning the pedal at a position of the half point stored in the memory when the data instructing the behavior of the pedal is indicative of an intermediate value of a depression depth of the pedal.

The present invention may be constructed and implemented not only as the method invention discussed above but also as an apparatus or device invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 7A and 7B are conceptual diagrams showing distribution information indicative of half regions determined by the half point determination processing for individual sound pitches (keys or notes) and pitch ranges.

DETAILED DESCRIPTION

Figure 1:
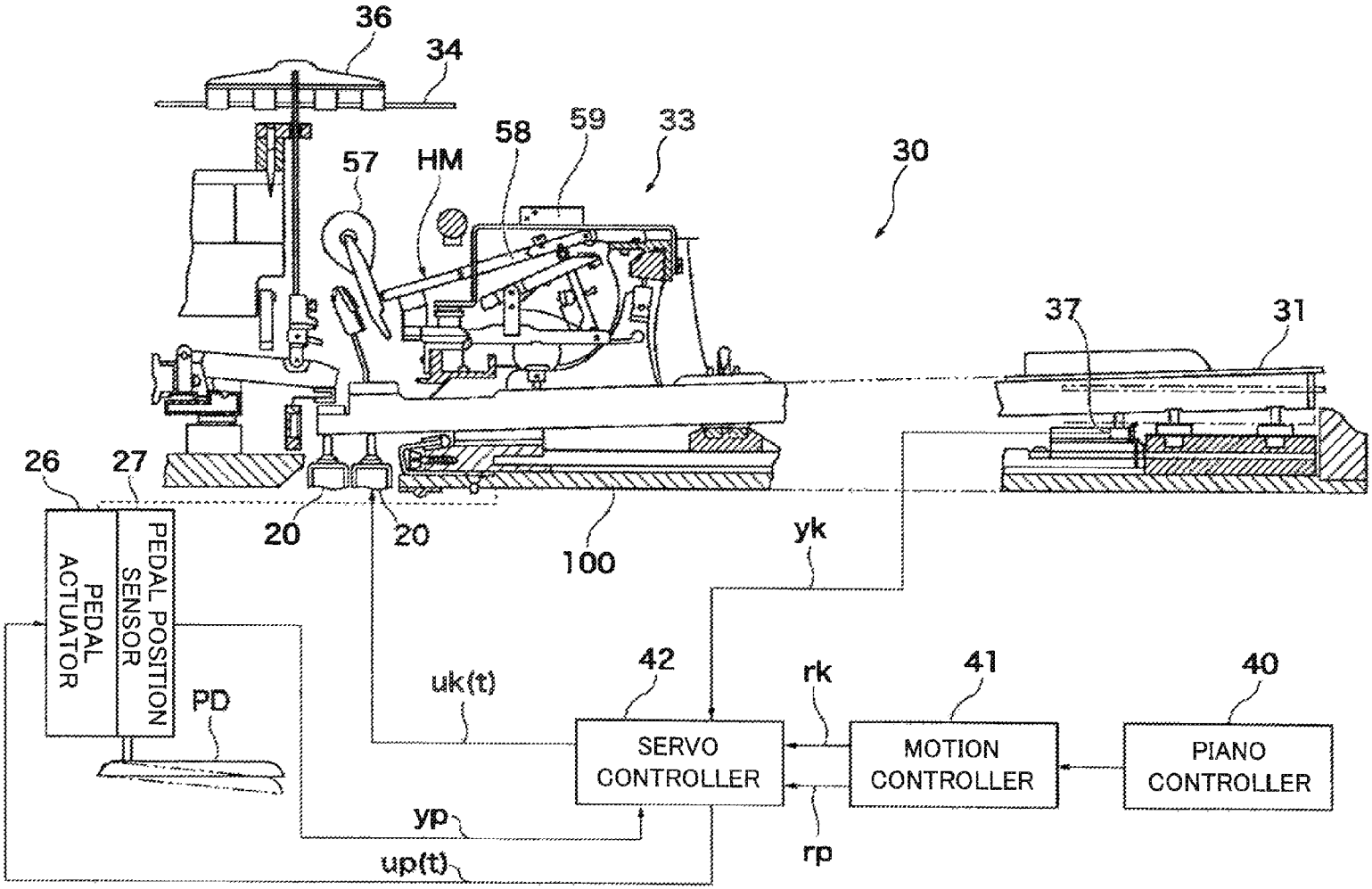
FIG. 1 is a partly sectional view showing an example construction of a keyboard musical instrument, particularly in relation to a given key, to which are applied a method and device for identifying a half point of a pedal in accordance with an embodiment of the present invention.

FIG. 1 is a partly sectional view showing an example construction of a keyboard musical instrument 30, particularly in relation to a given key, to which are applied a method and device for identifying a half point of a pedal in accordance with an embodiment of the present invention.

The keyboard musical instrument 30 is constructed as an auto-playing piano (player piano). Similarly to an ordinary acoustic piano, the keyboard musical instrument 30 includes, for each of a plurality of keys 31: one action mechanism 33 for transmitting motion of the key 31 to a single hammer HM; a set of strings (string set) 34 to be struck by the hammer HM; and a damper 36 for stopping vibrations of the string set 34.

The plurality of keys 31 are arranged in parallel in a left-right (horizontal) direction as viewed from the front of the keyboard musical instrument, and the hammers and the action mechanisms 33 are provided in corresponding relation to the keys 31. All of the hammers HM, action mechanisms 33 and keys 31 are disposed on a key frame 100. The key frame 100 is constructed to be displaceable in the left-right (horizontal) direction, i.e. in the arranged direction of the keys 31. Thus, in response to left-right (horizontal) displacement of the key frame 100, all of the hammers HM, action mechanisms 33 and keys 31 are displaced relative to the body of the keyboard musical instrument 30 in the left-right (horizontal) direction. By contrast, the string sets 34 provided in corresponding relation to the keys 31 are fixed to the body of the keyboard musical instrument 30 and thus can never be displaced together with the key frame 100.

Note that a side of the arrangement of the keys 31 closer to a human operator of the keyboard musical instrument 30 will hereinafter referred to as "front". Whereas, in the instant embodiment, the half point identifying device is incorporated integrally in the keyboard musical instrument 30, the half point identifying device may be provided separately from the keyboard musical instrument 30 and communicatably with the musical instrument 30.

The hammer MH includes a hammer shank 58 and a hammer head 57 and is pivotable in response to depression of the corresponding key, so that a sound is generated by the hammer head 57 striking the corresponding string set. The hammer head 57 is covered with a hammer felt. Note that each of the string sets 34, corresponding to one key 31 and one hammer HM, comprises one or more string elements (wire members) 34*a* to 34*c* arranged in substantial parallel to each other (one another) in the left-right direction.

In the keyboard musical instrument 30, a key drive unit including a solenoid 20*a* (FIG. 5) is provided for each of the keys 31 and located beneath a rear end portion of the key 31. Further, a key sensor unit 37 is provided for each of the keys 31 and located beneath a front end portion of the key 31, and the key sensor unit 37 continuously detects a current position of the key 31 to output a detection signal corresponding to a result of the detection.

The key sensor unit 37 includes, for example: a light emitting diode (LED), a light sensor for receiving light emitted from the light emitting diode to thereby output a detection signal corresponding to an amount of the received light; and a light blocking plate for changing an amount of light to be received by the light sensor in accordance with a depressed amount of the key 31. The detection signal which is output from the key sensor unit 37 as an analog signal is converted into a digital signal via a not-shown A/D converter and then supplied to a servo controller 42.

Further, a hammer sensor 59 is provided for each of the hammers HM. The hammer sensor 59 is located at a position where the hammer shank 58 is located when the hammer HM has reached near a pivoting-completed position in a forward or string-striking direction. The hammer sensor 59 is similar in construction to the sensor employed in the key sensor unit 37. The hammer sensor 59 detects passage thereby of the hammer shank 58 to thereby continuously detect a position of the hammer and outputs a detection signal corresponding to a result of the detection. Note that the hammer HM may be of any type as long as it is constructed to be capable of either continuously detecting a position of the hammer HM or detecting a velocity of the hammer HM.

Once a drive signal is supplied to the key drive unit 20 corresponding to a sound pitch defined by sound generation event data included in performance data, a solenoid plunger of the key drive unit 20 ascends to push up a rear end portion of the corresponding key 31. Thus, the key 31 is depressed and the string set 34 corresponding to the depressed key 31 is struck by the hammer head 57 corresponding to the depressed key 31, so that a piano sound is generated.

The keyboard musical instrument 30 includes, as pedals depressable by feet of the human player, not only a shift pedal PD but also a not-shown loud pedal (damper pedal) for driving the dampers 36 and a not-shown sostenuto pedal. The key frame 100 is displaced from an initial position in one horizontal direction (rightward direction) in response to depression of the shift pedal PD, and, upon termination of the depression, the key frame 100 and the shift pedal PD return to their respective initial positions by biasing force of not-shown biasing members.

Also provided are a pedal actuator 26 for driving the shift pedal PD, and a pedal position sensor 27 for continuously detecting a current position (depressed amount) of the shift pedal PD. The pedal position sensor 27 is similar in construction to the sensor of the key sensor unit 37. The pedal actuator 26 includes a not-shown solenoid coil and a not-shown plunger connected to the shift pedal PD, and once a dive signal is supplied, the plunger moves to drive the shift pedal PD. Although not particularly shown, similar actuators and sensors are provided for the other pedals. The shift pedal PD is constructed to make a stroke motion in response to a depressing operation performed thereon by a human player's foot or the actuator 26. The pedal position sensor 27 is used to detect a plurality of different stroke positions within one stroke of the shift pedal PD.

The depressed amount of the shift pedal PD and the displaced amount of the key frame 100 from the initial position are proportional to each other. Because the hammer HM is displaced horizontally in response to the horizontal displacement of the key frame 100, the shift pedal PD functions as a pedal for making variable the "non-key-depressed-state corresponding position (i.e., rest position) of the hammer HM in the non-key-depressed state. Because the depressed amount of the shift pedal PD serves to define the non-key-depressed-state corresponding position (i.e., rest position) of the hammer HM, the pedal position sensor 27 may be replaced with any other sensor constructed to directly or indirectly detect the non-key-depressed-state corresponding position (rest position) of the shift pedal PD or hammer HM. For example, the pedal position sensor 27 may be replaced with a sensor for detecting a displaced amount, in the left-right direction, of the key frame 100 or a component part (e.g., hammer HM) displaceable together with the key frame 100, rather than the depressed amount of the shift pedal PD.

Further, the keyboard musical instrument 30 includes a piano controller 40, a motion controller 41 and the servo controller 42. The piano controller 40 supplies performance data to the motion controller 41. The performance data comprise, for example, MIDI (Musical Instrument Digital Interface) codes and define behavior of the individual keys 31 and individual pedals.

Because similar pedal control is performed on each of the pedals, the following paragraphs representatively describe only the pedal control to be performed on the shift pedal PD.

The motion controller 41 generates, on the basis of the supplied performance data, position control data rp and rk corresponding to respective target positions of the shift pedal PD and keys at each time point t and supplies the generated position control data rp and rk to the servo controller 42. Meanwhile, a detection signal of the pedal position sensor 27 is supplied as a feedback signal yp to the servo controller 42, and a detection signal of the key sensor unit 37 is supplied as a feedback signal yk to the servo controller 42. Note that a signal output from the solenoid 20*a* of the key drive unit 20 may be used as the above-mentioned feedback signal yk.

The servo controller 42 generates electric current instructing values up(t) and uk(t) as energizing electric currents corresponding to the position control data rp and rk and supplies the generated electric current instructing values up(t) and uk(t) to the pedal actuator 26 and the key drive units 20, respectively. Actually, these electric current instructing values up(t) and uk(t) are each a PWM signal having been subjected to pulse width modulation in such a manner as to have a duty ratio corresponding to a target value of an average electric current to be fed to the solenoid coil of the pedal actuator 26 or the key drive units 20.

In an automatic performance based on performance data, the servo controller 42 performs servo control by comparing the position control data rp and rk and the feedback signals yp and yk, respectively, and outputting the electric current instructing values up(t) and uk(t) after updating as necessary the electric current instructing values up(t) and uk(t) so that the compared position control data rp and rk and the feedback signals yp and yk coincide with each other. In this way, the automatic performance is executed by the shift pedal PD and the keys 31 being driven in accordance with the performance data.

Figure 2:
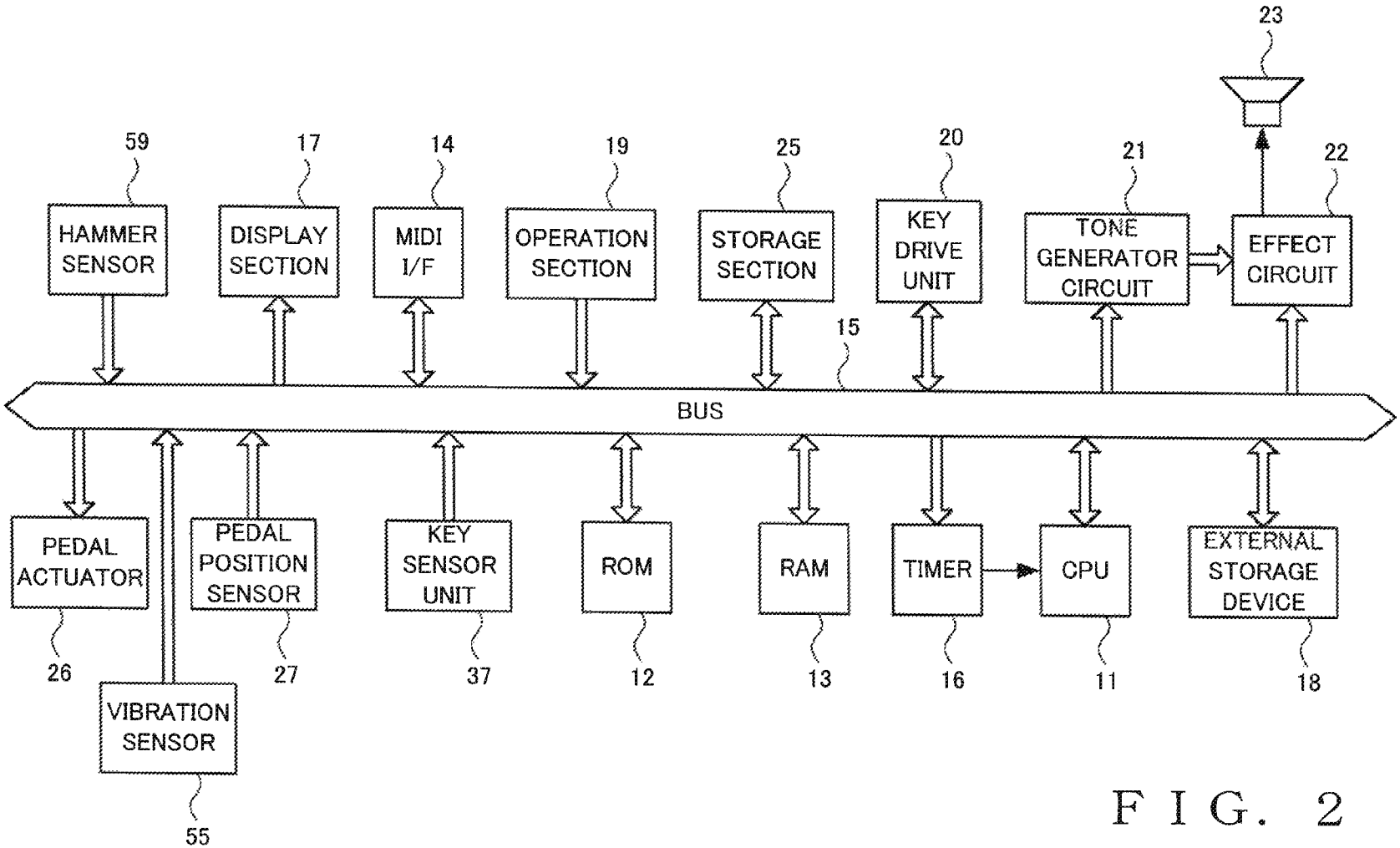
FIG. 2 is a block diagram showing an example construction of a control mechanism of the keyboard musical instrument.

FIG. 2 is a block diagram showing an example construction of a control mechanism of the keyboard musical instrument 30. The control mechanism includes a CPU 11 to which are connected, via a bus 15, the key drive units 20, the petal actuator 26, the pedal position sensor 27, vibration sensors 55, the key sensor units 37, the hammer sensors 59, a ROM 12, a RAM 13, a MIDI interface (MIDI I/F) 14, a timer 16, a display section 17, an external storage device 18, an operation section 19, a tone generator circuit 21, an effect circuit 22 and a storage section 25. A sound system 23 is connected via the effect circuit 22 to the tone generator circuit 21.

The CPU 11 controls the entire keyboard musical instrument 30. The ROM 12 stores therein control programs for execution by the CPU 11 and various data, such as table data. The RAM 13 temporarily stores therein, among other things, various input information, such as performance data and text data, various flags, buffered data, and results of arithmetic operations. The MIDI (I/F) 14 inputs, as MIDI signals, performance data transmitted from not-shown MIDI equipment. The timer 16 counts interrupt times in timer interrupt processes and various time lengths. The display section 17 includes, for example, an LCD and displays various information, such as a musical score. The external storage device 18 is capable of accessing a not-shown portable storage medium, such as a flexible disk and reading and writing data, such as performance data, from and to the portable storage medium. The operation section 19, which includes not-shown operators (input members) of various types, is operable to instruct a start/stop of an automatic performance, instruct selection of a music piece and make various settings. The storage section 25, which comprises a non-volatile memory, such as a flash memory, can store various data, such as performance data.

The tone generator circuit 21 converts performance data into tone signals. The effect circuit 22 imparts various effects to the tone signals input from the tone generator circuit 21, and the sound system 23, which includes a D/A (Digital-to-Analog) converter, amplifier, speaker, etc., converts the tone signals and the like input from the effect circuit 22 into audible sounds.

Note that the functions of the motion controller 41 and the servo controller 42 are actually implemented by cooperation among the CPU 11, timer 16, ROM 12, RAM 13, etc. Signals output from the various sensors are supplied via a not-shown A/D (Analog-to-Digital) converter to the CPU 11.

Figure 3:
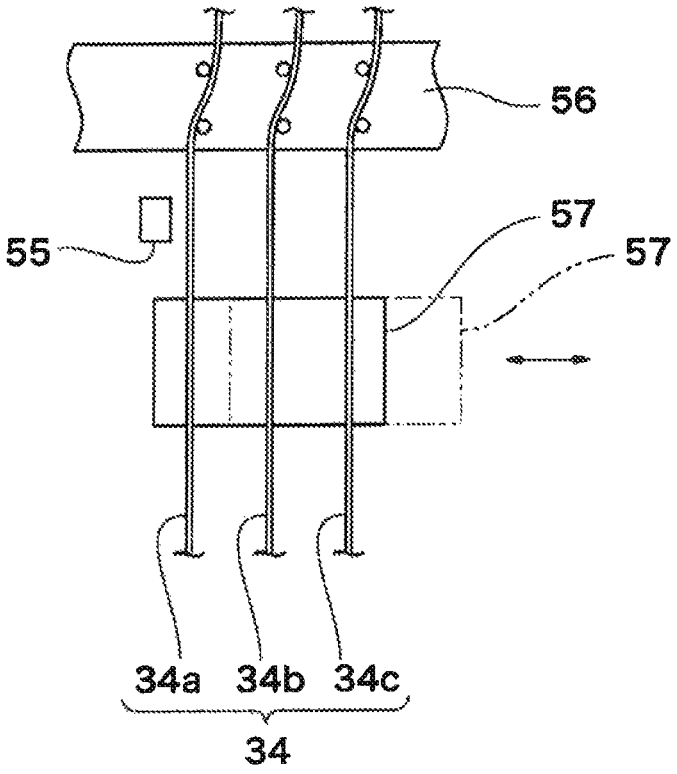
FIG. 3 is a schematic plan view showing relationship between a hammer head and a string set in a high pitch range of the keyboard musical instrument.

FIG. 3 is a schematic plan view showing relationship between one of the hammer heads 57 and one string set 34 corresponding to the hammer head 57 in the high pitch range. The string set 34 is provided in corresponding relation to the key 31 and the hammer HM, and the number of component wire members (string elements) constituting the string set 34 differs depending on the pitch range which the string set 34 belongs to; namely, the number of wire members is one in the lowest pitch range, two in the low pitch range, and three in the medium and higher pitch ranges. In the illustrated example of FIG. 3, the string set 34 is in the high pitch range and comprises three wire members 34*a*, 34*b* and 34*c* arranged in substantially parallel relation to one another in the left-right horizontal direction. The three wire members 34*a* to 34*c* are stretched taut by being engaged by a bridge 56.

Let's now consider the non-key-depressed-state corresponding position of the hammer HM or hammer head 57. When the shift pedal PD is in the non-depressed state, the hammer head 57 takes a non-key-depressed-state corresponding position where it overlaps all of the three wire members 34*a* to 34*c* as viewed in plan. Thus, as the key is depressed in such a state, all of the three members 34*a* to 34*c* are struck by the hammer head 57.

As the shift pedal PD is depressed, the hammer head 57 is displaced to the right together with the key frame 100. Then, when the shift pedal PD has been depressed to the completely-depressed position, the hammer head 57 takes a non-key-depressed-state corresponding position where it overlaps the right two (34*b* and 34*c*) of the three wire members without overlapping the left-end wire member 34*a* as viewed in plan. Thus, with the key depressed in such a state, only the two wire members 34*b* and 34*c* are struck by the hammer head 57 without the left-end wire member 34*a* being struck by the hammer head 57. Actually, the human player can execute a performance operation where the human player depresses the key with the shift pedal PD stopped at a halfway position of the depression stroke; in such a case, the left-end wire member 34*a* can be struck incompletely.

A portion of the hammer head 57 abutting against the three wire members 34*a* to 34*c* when the shift pedal PD is in the non-depressed state would have a greater dent and greater hardness than other portions due to its frequent string striking. Because irregularities (concavities and convexities) and unevenness in hardness exist in the left-right direction on the hammer head 57 due to frequent string striking operation of the hammer head 57, the string striking action of the hammer head 57 tends to vary depending on the depressed position of the shift pedal PD. Thus, the portion of the hammer head 57 striking the string set 34 can be changed by adjusting the depressed position of the shift pedal PD, so that subtle variations of tone characteristics (sound color and volume) can be obtained.

Although generally the same behavior as above takes place in the low pitch range, the number of wire members to be struck by the hammer HM changes between one and two depending on the depressed position of the shift pedal PD. Further, in the lowest pitch range, the string-striking portion of the hammer head 57 changes, for example, between a middle portion and an end portion although the number of wire members to be struck is just one and does not change. For example, when the hammer head 57 strikes one string (wire member) by beans of an end portion thereof, there can be obtained sound quality different from that when the hammer head 57 strikes the one string (wire member) by means of a middle portion thereof.

The vibration sensor 55 is provided near the wire member 34*a* and detects vibrations of the wire member 34*a* in a non-contact fashion. The vibration sensor 55 may be constructed in any desired manner and located at any desired position as long as it can appropriately detect vibrations of the wire member 34*a*.

In the depressing stroke of the shift pedal PD, there is a region or point where tone characteristics produced by string striking change from those in the non-depressed state to those in the completely-depressed state. Such a region or point will hereinafter be referred to as a "half region" or "half point" of the shift pedal PD.

Because the half region of the shift pedal PD and the half point HP in the half region differ subtly from one keyboard musical instrument to another, it is necessary to figure out or identify in advance the half point HP of the keyboard musical instrument 30, in order to appropriately drive the pedal in an automatic performance. Here, the half point HP is represented, for example, as a distance (mm), in an operating (depressing) direction of the shift pedal PD, from the rest position (non-operated position) of the shift pedal PD. Alternatively, however, the half point HP may be represented as a displaced amount of a given member, such as the key frame 100, that is displaced in response to an operation of the shift pedal PD.

In the instant embodiment, the setting of the non-key-depressed-state corresponding position of the hammer HM is changed by variously changing the depressed position of the shift pedal PD, and a coefficient of rebound when the key has been depressed to cause the hammer HM to strike the string set is determined for each of the plurality of non-key-depressed-state corresponding positions. Such a coefficient of rebound eH is determined, from a result of the detection by the hammer sensor 59, as a ratio of a string releasing velocity vHn (<0) immediately after the string striking to a string striking velocity vHp immediately before the string striking at a same position.

The non-key-depressed-state corresponding position of the hammer HM corresponds to the rest position of the hammer head 57, a displaced amount of the hemmer head 57 is proportional to displaced amounts of the key frame 100 and shift pedal PD, and movable strokes of the hammer head 57, key frame 100 and shift pedal PD correspond to one another. Therefore, the term "non-key-depressed-state corresponding position" is sometimes used in relation to the position of the shift pedal PD. As will be described in detail later, when applying the method for identifying a half point of the shift pedal PD in accordance with the basic principles of the present invention, the non-key-depressed-state corresponding position (rest position) are set to various positions by being various changed, and the string set 34 is struck by the hammer HM with each of the thus-set non-key-depressed-state corresponding positions (rest positions) used as a striking start position. Namely, striking, by the hammer HM, of the string set 34 is executed for each of the set non-key-depressed-state corresponding positions (rest positions). As one example of the way of setting such a plurality of non-key-depressed-state corresponding positions (rest positions), non-key-depressed-state corresponding positions (rest positions), i.e. striking start positions, of the hammer HM may be set in association with any of stroke positions that are represented with resolution determined by segmenting a full stroke, from the non-depressed position to the completely depressed position, of the shift pedal PD at predetermined intervals, such as 1 mm intervals.

Figure 4:
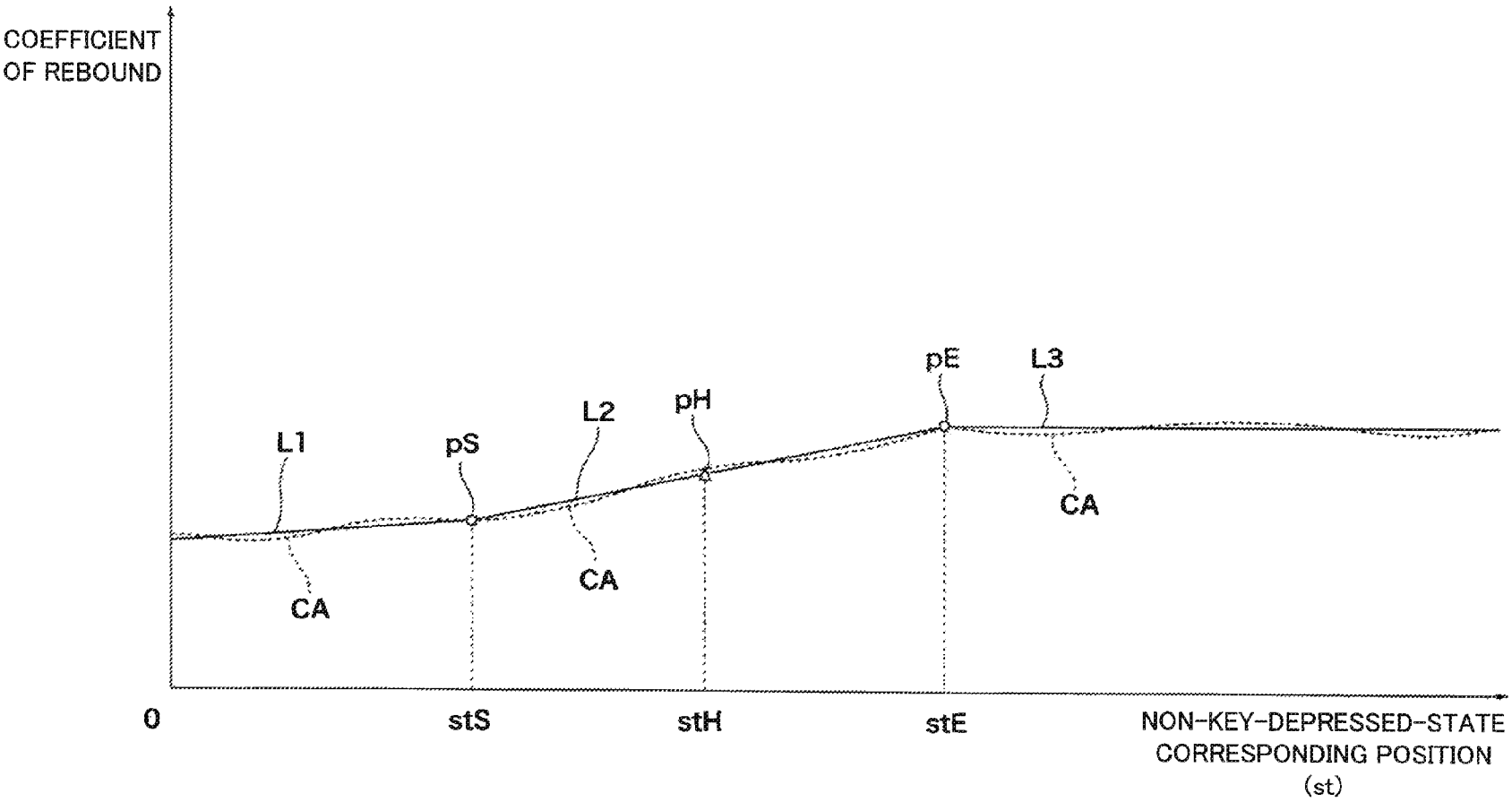
FIG. 4 is a diagram showing an example of a curve indicative of relationship between non-key-depressed-state corresponding positions and coefficients of rebound.

In a curve calculation process (step S110) in later-described half point determination processing of FIG. 6, the CPU 11 calculates a curve CA (see FIG. 4) indicative of a variation of the coefficient of rebound eH versus the non-key-depressed-state corresponding position (st). Namely, FIG. 4A is a diagram showing an example of the curve CA representative of relationship between the coefficient of rebound eH and the non-key-depressed-state corresponding position st. In FIG. 4, the horizontal axis represents the non-key-depressed-state corresponding position st that is a position from a zero (0) depressed amount in the depressing direction (forward direction), while the vertical axis represents the coefficient of rebound eH(=−string releasing velocity vHn/string striking velocity vHp).

Figure 5:
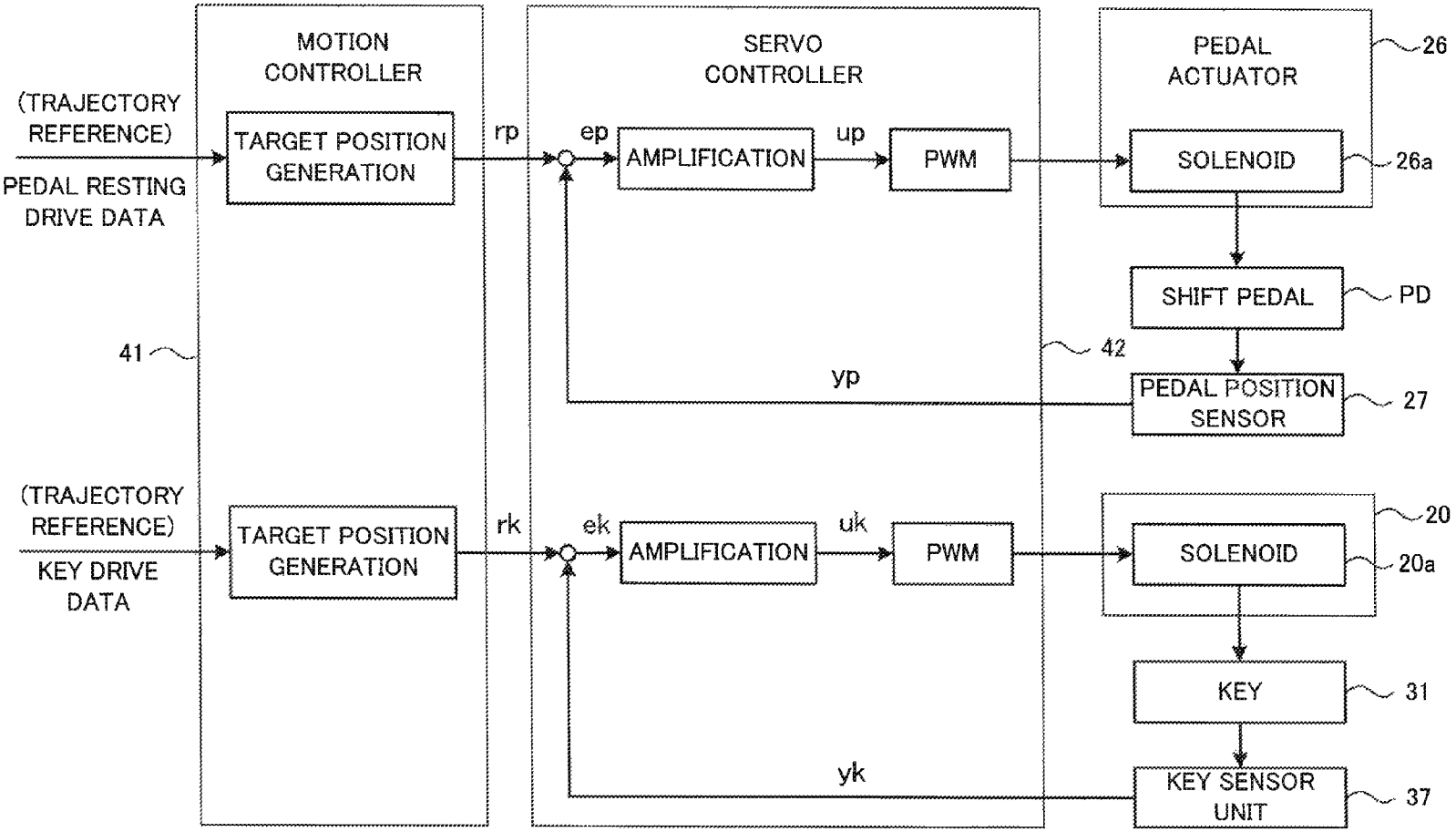
FIG. 5 is a block diagram showing example operational flows of servo drive for a curve calculation process.

FIG. 5 is a block diagram showing example operational flows of servo drive for the curve (CA) calculation process. FIG. 6 is a flow chart showing an example operational sequence of the half point determination processing, and the half point determination processing of FIG. 6 is performed separately for each of the keys 31.

In the instant embodiment, "pedal-resting drive data" for resting the shift pedal PD at a set non-key-depressed-state corresponding position is prepared in advance for each of the settings. Further, "key drive data" for depressing the key 31 is prepared for each of the settings of the non-key-depressed-state corresponding position (namely, the rest position of the hammer HM). In the instant embodiment of the invention, a same key depression velocity (i.e., key depression intensity, or striking velocity or intensity of the hammer HM) is set for each of striking actions of the hammer HM started from the non-key-depressed-state corresponding positions (i.e., different rest positions), and thus, it is assumed that same or common key drive data is used for each of the settings of the non-key-depressed-state corresponding position.

As shown in FIG. 5, the above-mentioned pedal-resting drive data and key drive data are supplied from the piano controller 40 to the motion controller 41 similarly to the aforementioned performance data, so that position control data corresponding to the individual drive data are supplied to the servo controller 42.

Then, the servo controller 42 performs feedback control to supply an electric current instructing value up(t), based on the position control data corresponding to the pedal-resting drive data, to the solenoid 26*a* of the pedal actuator 26. Then, the shift pedal PD is driven by the pedal actuator 26 to maintain a rest state at the set non-key-depressed-state corresponding position.

Meanwhile, or in parallel with the above, the servo controller 42 performs feedback control to supply an electric current instructing value uk(t), based on the position control data corresponding to the key drive data, to the solenoid 20*a* of the key drive unit 20, so that the key 31 is depressed.

Figure 6:
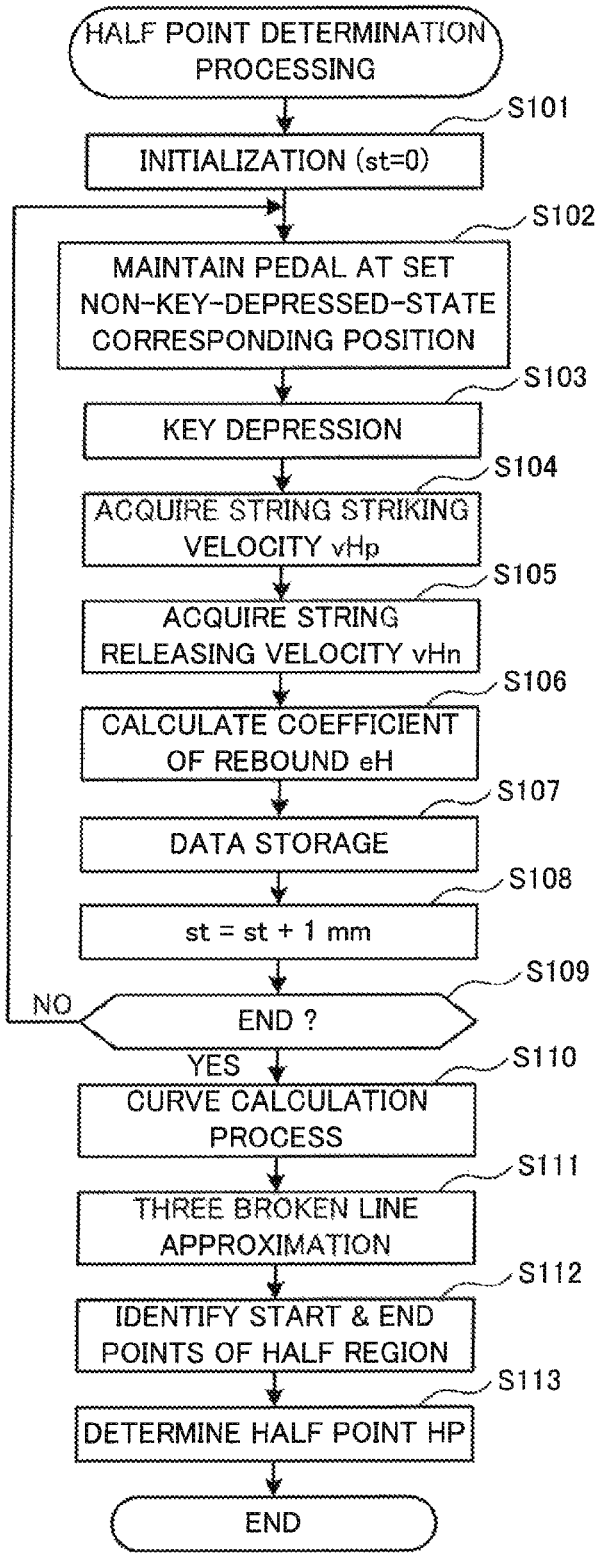
FIG. 6 is a flow chart showing an example operational sequence of half point determination processing.

Continuing to refer to FIGS. 5 and 6, predetermined initialization is performed at step S101. Namely, the non-key-depressed-state corresponding position st of the shift pedal) is set at the non-depressed position (i.e., st=0).

Next, at step S102, the pedal-resting drive data corresponding to the set non-key-depressed-state corresponding position st is read out to drive the shift pedal PD in accordance with the pedal-resting drive data and with reference to a result of the detection by the pedal position sensor 27 so that the shift pedal PD is kept at the set non-key-depressed-state corresponding position st. Further, in that state, the key drive data is read out to perform key depression in accordance with the read-out key drive data.

Namely, at steps S102 and 103, the motion controller 41, as shown in FIG. 5, acquires trajectory references based on respective ones of the pedal-resting drive data and key drive data, generates a target position (position control data rp) for the shift pedal PD and target position (position control data rk) for the key 31 both corresponding to the current time t and then outputs the thus-generated target positions to the servo controller 42. In short, at these steps S102 and S103, operations are performed for striking the string set 34 by means of the hammer HM in association with individual ones of different rest positions of the hammer HM, wherein each of the different rest positions of the hammer HM corresponds to each of a plurality of stroke positions within a single stroke of the pedal PD.

Then, the servo controller 42 obtains feedback signals yp and yk from the pedal position sensor 27 and key sensor unit 37 and calculates differences ep and ek between the output position control data rp and rk and the feedback signals yp and yk, respectively. Then, the servo controller 42 PWM-modulates electric current instructing values up and uk obtained by amplifying the differences e and ek and then outputs the PWM-modulated electric current instructing values up and uk to the solenoid 26*a* of the pedal actuator 26 and the solenoid 20*a* of the key drive unit 20. In the instant embodiment of the invention, the non-key-depressed-state corresponding position st is represented by a value based on the feedback signal yp that is a detection signal of the pedal position sensor 27.

Then, at steps (acquisition steps) S104 and 105, a string striking velocity vHp (i.e., velocity of the hammer immediately before the string striking) and a string releasing velocity Hn (i.e., velocity of the hammer immediately after the string striking) are acquired from results of the detection by the hammer sensor 59. A coefficient of rebound eH is calculated from the string releasing velocity vHn at next step S106, and the thus-calculated coefficient of rebound eH is stored, at nest step S107, into the RAM 13 in association with the current value of the non-key-depressed-state corresponding position st that is, in effect, the current detection value of the pedal position sensor 27.

At next step S108, the non-key-depressed-state corresponding position st of the shift pedal PD is incremented by 1 mm (st=st+1). Then, at step S109, a determination is made as to whether the non-key-depressed-state corresponding position st has reached the end position. If the non-key-depressed-state corresponding position st has not yet reached the end position as determined at step S109 (NO determination at step S109), the processing reverts to step S102. Thus, at step S102, the shift pedal PD is driven in accordance with the pedal-resting drive data corresponding to the updated non-key-depressed-state corresponding position st. In short, these steps S104 to S109 are detection steps for, in response to the hammer HM striking the string set 34, detecting data indicative of at least one of behavior of the hammer 11M and reaction of the string set 34 and for detecting the data in association with the individual ones of the plurality of stroke positions.

Once the non-key-depressed-state corresponding position st has reached the end position (YES determination at step S109), the processing proceeds to step S110 to perform the curve calculation process, where the curve CA shown in FIG. 4 is calculated on the basis of a plurality of sets of coefficients of rebound al and non-key-depressed-state corresponding positions st stored in memory.

Note that the aforementioned curve calculation process may be performed on the same non-key-depressed-state corresponding position st a plurality of times (e.g., ten times) so that a plurality of coefficients of rebound eH may be obtained and stored in advance. Alternatively, an average of a plurality of coefficients of rebound eH obtained for the same non-key-depressed-state corresponding position st may be calculated so that the average is set as the coefficient of rebound eH.

Then, at step S111, a linear approximation process is performed where the calculated curve CA is approximated with three broken lines. Thus, the curve CA is approximated with first to third linear lines L1 to L3 as shown in FIG. 4. In FIG. 4, pS indicates a point of intersection between the first linear line L1 and the second linear line L2, and pE indicates a point of intersection between the second linear line L2 and the third linear line L3.

Then, at step S112, start and end points of a half region are identified on the basis of the points of intersection pS and pE. Namely, the points of intersection pS and pE represent particular points at which an inclination of the curve CA changes abruptly. Thus, the points of intersection pS and pE may be regarded as corresponding respectively to a position where overlapping of the hammer head 57 with the outmost (left-end) wire member 34*a* in the string set 34 starts being canceled in the depressing stroke of the shift pedal PD and a position where the cancellation of the overlapping of the hammer head 57 with the outmost wire member 34*a* finishes in the depressing stroke of the shift pedal PD, as viewed in a plan view like FIG. 3. Thus, in the instant embodiment, the non-key-depressed-state corresponding position st corresponding to the point of intersection pS is identified as the start point stS of the half region, while the non-key-depressed-state corresponding position st corresponding to the point of intersection pE is identified as the end point stE of the half region.

Note that, in the lowest pitch range, such abrupt inclination might sometimes not clearly appear. Thus, in such a case, half regions may be identified only in the low, medium pitch range and high pitch range.

Then, at step (identification step) S113 of the half point determination processing of FIG. 6, a half point HP is determined on the basis of the points of intersection pS and pE or the start point stS and end point stE. Namely, a point at which a segment between the start point stS and the end point stE is internally divided with a predetermined internal division ratio is determined as the half point HP. In the instant embodiment, "1:1" is employed as an example of the predetermined internal division ratio. In this manner, a middle position stH between the start point stS and the end point stE is determined as the half point HP, as shown in FIG. 4. The middle position stH is also a position of the shift pedal PD corresponding to the point pH at which a segment between the points of intersection pS and pE is internally divided with the predetermined internal division ratio. After step S113, the half point determination processing of FIG. 6 is brought to an end.

Because the half point HP is determined on the basis of the internal division ratio between the start point stS and end point stE obtained through the aforementioned linear approximation of the curve CA, the half point HP can be identified accurately and easily.

The half point determination processing of FIG. 6 is performed separately for each of the keys 31 to determine a respective half point HP for each of the keys 31. Alternatively, the half point determination processing of FIG. 6 may be performed concurrently or in parallel for a plurality of the keys 31.

FIG. 7A is a conceptual diagram showing distribution information indicative of half regions determined by the half point determination processing of FIG. 6 performed for individual sound pitches or notes (keys 31).

As shown, values of the start point stS and end point stE and the half point HP are stored in the RAM 13 in association with the notes or keys 31. It is preferable that such distribution information of the half regions be stored in the non-volatile storage section 25 because the distribution information is indicative of current characteristics of the shift pedal PD of the keyboard musical instrument.

In fact, when performing feedback control on the operation or behavior of the shift pedal PD in an automatic performance based on performance data, it is more convenient to determine the half point HP as a single value. Thus, a single half region and a single half point HP are determined on the basis of the half region distribution information shown in FIG. 7A. Although such a single half region and a single half point HP may be determined in any desired manner, a segment between the smallest value of the start point stS and the largest value of the end point stE may be determined as the half region and a middle point in the half region may be determined as the half point HP. Further, as the half point HP, an average of the half points HP corresponding to all of the keys 31 may be used.

The servo controller 42 reflects the value (stH) of the thus-determined half point HP in feedback control of the behavior of the shift pedal PD in the automatic performance based on performance data. More specifically, when setting an electric current instructing value up(t) in accordance with the position control data rp, the servo controller performs an arithmetic process on a data value, included in the performance data and defining an intermediate value of an operating or depression depth of the shift pedal PD, in such a manner that the shift pedal PD is located at the position stH of the half point HP. In this way, it is possible to appropriately enhance the reproducibility of the performance.

Alternatively, half region distribution information may be stored per pitch range, as shown in FIG. 7B. For example, the string sets 34 may be divided into ranges in accordance with the number of component wire members, i.e. range (lowest pitch range) where the number of component wire members is one, range (low pitch range) where the number of component wire members is two, and ranges (medium and high pitch range) where the number of component wire members is three, and half region distribution information may be defined separately for each of the divided ranges.

As should be clear from the foregoing, the half-point identifying data of the shift pedal PD stored in a suitable memory, such as the storage section 25, as shown in FIG. 7A or 7B can be used advantageously when an automatic performance of a piano is to be executed on the basis of automatic performance data of the MIDI or other suitable format. In such an automatic piano performance, there can be realized a method for reproducing a half-point performance of the shift pedal PD (or soft pedal) in accordance with the basic principles of the present invention. In short, the method for reproducing a half-point performance of the shift pedal PD (or soft pedal) in accordance with the basic principles of the present invention comprises: a step of providing a memory (e.g., storage section 25) storing therein data identifying a half point of the shift pedal PD (or soft pedal); a step of striking the string set 34 by the hammer KM in accordance with automatic performance data including at least data for driving the key 31; and a step of automatically driving the shift pedal PD (or soft pedal) in accordance with data included in the automatic performance data and instructing operation or behavior of the pedal, the step positioning the pedal at a position of the half point stored in the memory (e.g., storage section 25) if the data instructing the operation or behavior of the pedal is indicative of an intermediate value of the operating or depression depth of the pedal. As noted above, the operations of the individual steps are executed in a specific manner by the CPU 11 and the servo controller 42.

With the instant embodiment, where a curve CA indicative of a variation of the coefficient of rebound eH is determined separately for each non-key-depressed-state corresponding position and where points of intersection pS and pE represent points at which an inclination of the curve CA changes abruptly are determined, it is possible to accurately and easily identify a half region and a half point HP of the shift pedal PD.

Whereas the instant embodiment of the invention has been described above in relation to the case where the string striking velocity vHp and string releasing velocity vHn and coefficient of rebound eH immediately before and after string striking, which is a ratio between the string striking velocity vHp and the string releasing velocity are described as examples of physical amounts to be acquired per non-key-depressed-state corresponding position, the physical amounts to be acquired per non-key-depressed-state corresponding position are not limited to the aforementioned examples alone and may be other physical amounts as long as they are indicative of operation or behavior of the hammer HM or string set 34.

For example, a time length necessary for the hammer HM to move forward and backward through a section between predetermined two points may be measured so that a difference between a required time in a forward direction and a required time in a backward direction is acquired as a physical amount indicative of operation or behavior of the hammer HM. Alternatively, assuming that a key depressing velocity is the same irrespective of settings of the non-key-depressed-state corresponding position, a velocity of the hammer HM after string striking (i.e., string releasing velocity) at a given position may be acquired as a physical amount indicative of the operation of the hammer HM. In these cases, the time length necessary for the hammer HM to move forward and backward through a section between predetermined two points and the string releasing velocity of the hammer HM are detected at a position at least closer to the string set 34 than a backcheck position.

Further, of the three wire members of the string set 34, vibrations of the outmost wire member 34*a* (predetermined wire member) which the hammer head does not contact or abut against in the completely depressed state of the shift pedal PD may be acquired as a physical amount indicative of the operation of the hammer HM. The vibrations of the outmost wire member 34*a* are detectable, for example, by the vibration sensor 55 (FIG. 3).

Additionally, in view of the fact that harmonics (overtones) change as the number of wire members to be struck changes, harmonics of a tone generated from the string set 34 may be observed so that a half point can be identified from change points of a harmonic structure.

As another modification, a mechanism may be provided for directly driving the hammer HM so that a coefficient of rebound eH can be obtained in the half point determination processing of FIG. 6 by directly pivotally driving the hammer HM in the forward direction, rather than in response to depression of the key.

The half point determination processing of FIG. 6 has been described above in relation to the case where the operation for changing little by little the non-key-depressed-state corresponding position of the hammer HM and the key depression operation are performed through servo driving of the shift pedal PD and the key 31. However, the above-mentioned means for driving the shift pedal PD and the key 31 are not necessarily limited to the control via the motion controller 41, servo controller 42, etc. using the drive data, and such means may also be manual means. For example, the shift pedal PD may be fixed after being manually displaced a predetermined amount (e.g., 1 mm) by a predetermined amount, and a coefficient of rebound eH may be determined by depressing the key 31 in that state.

Note that the pedal to which the present invention is applied may be any desired pedal as along as an initial position of the hammer HM relative to the string set 34 in the non-key-depressed state can be made variable by a depressing operation of the pedal, namely, as long as, even with a same style of key depression, the pedal can change its style of abutment (i.e., the number of wire members to be struck by the hammer, string striking velocity or abutted portion of the hammer, or the like) against the string set 34 to thereby vary a sound volume or color.

Thus, even where the keyboard musical instrument is of the upright type, it is conceivable that, depending on structures of the pedal and action mechanism, a construction is employed where there is a particular point where tone characteristics change in the middle of depression of the pedal. The present invention is applicable to such a keyboard musical instrument.

It should be appreciated that the objects of the present invention can be accomplished by supplying a system or apparatus or device with a storage medium having stored therein program codes of software implementing the functions of the above-described embodiment so that a computer (CPU, MPU or the like) of the system or apparatus or device reads out and executes the program codes stored in the storage medium. In such a case, the program codes read out from the storage medium themselves implement the functions of the present invention, and these program codes and the storage medium having stored there in the program codes together implement the present invention.

Furthermore, the storage medium for supplying the program codes may be, for example, a floppy (registered trademark) disk, hard disk, magneto-optical disk, CD-ROM, CD-R, CD-RW, DVD-ROM, DVD-RAM, DVD-RW, DVD±RW, magnetic tape, non-volatile memory card, ROM or the like. As an alternative, the program codes may be downloaded from a server computer via a communication network.

Moreover, whereas the functions of the above-described embodiment of the invention have been described above as implemented by a computer reading out and executing the program codes, they may of course be implemented by an OS and the like, running on the computer, performing a part or whole of the actual processing on the basis of the instructions of the program codes.

Furthermore, needless to say, the program codes, read out from the storage medium, may be written into a memory provided on a function extension board inserted in the computer or on a function extension unit connected to the computer so that the functions of the above-described embodiment can be implemented by a CPU and the like, provided on the function extension board or the function extension unit, performing a part or whole of the actual processing on the basis of the instructions of the program codes.

This application is based on, and claims priority to, JP PA 2012-287149 filed on 28 Dec. 2012. The disclosure of the priority application, in its entirety, including the drawings, claims, and the specification thereof, are incorporated herein by reference.

What is claimed is:

1. A method for identifying a half point of a pedal on a keyboard musical instrument, the keyboard musical instrument including: a key; a hammer constructed to make a pivotal motion in response to an operation of the key; and a string set comprised of at least one wire member and constructed to be struck by the hammer and the pedal constructed to make a stroke motion in response to a depressing operation performed thereon, the pedal being constructed to change a rest position of the hammer relative to the string set in accordance with a stroke position thereof, said method comprising:

a step of striking the string set by the hammer in association with individual ones of different rest positions of the hammer, each of the different rest positions of the hammer corresponding to each of a plurality of stroke positions within one stroke of the pedal;

a detection step of, in response to the hammer striking the string set, detecting data indicative of at least one of behavior of the hammer and reaction of the string set, said detection step detecting the data in association with the individual ones of the plurality of stroke positions; and an identification step of identifying a half point of the pedal on a basis of the data detected by said detection step in association with the plurality of stroke positions.

2. The method as defined in claim 1, wherein said identification step identifies a half region, indicative of a transient variation characteristic, on a basis of a distribution curve of the data detected in association with the plurality of stroke positions and identifies the half point in the identified half region.

3. The method as defined in claim 1, wherein said detection step detects a string striking velocity of the hammer and a string releasing velocity of the hammer after striking of the string set and calculates, as a coefficient of rebound indicative of the reaction of the string set, a ratio of the string striking velocity to the string releasing velocity.

4. The method as defined in claim 1, wherein the string set comprises at least two wire members and is constructed so as not to abut against an outermost wire member of the at least two wire members of the string set in response to depression of the key in a completely-depressed state of the pedal, and said detection step detects vibrations of the outermost wire member as data indicative of the reaction of the string set.

5. The method as defined in claim 1, wherein the string set comprises at least two wire members, and said detection step detects the data indicative of the reaction of the string set on a basis of analyzing a harmonic structure of a sound generated by vibrations of the string set.

6. The method as defined in claim 1, wherein said step of striking strikes the string set by the hammer that is moved with a same intensity in each of striking actions started from the different rest positions.

7. The method as defined in claim 1, wherein the keyboard musical instrument includes a plurality of the keys, and said identification step identifies the half point for each of the keys.

8. The method as defined in claim 1, wherein the keyboard musical instrument includes a plurality of the keys, and said identification step identifies one half point in correspondence with a group of the keys.

9. The method as defined in claim 1, which further comprises a step of storing the half point, identified by said identification step, into a memory.

10. The method as defined in claim 9, which further comprises:

a step of striking the string set by the hammer in accordance with automatic performance data including at least data for driving the key;

a driving step of automatically driving the pedal in accordance with data included in the automatic performance data and instructing behavior of the pedal, said driving step positioning the pedal at a position of the half point stored in the memory when said data instructing behavior of the pedal is indicative of an intermediate value of a depression depth of the pedal.

11. A non-transitory computer-readable storage medium storing a program executable by a processor to perform a method for identifying a half point of a pedal on a keyboard musical instrument, the keyboard musical instrument including: a key; a hammer constructed to make a pivotal motion in response to an operation of the key; and a string set comprised of at least one wire member and constructed to be struck by the hammer and the pedal configured to make a stroke motion in response to a depressing operation performed thereon, the pedal being constructed to change a rest position of the hammer relative to the string set in accordance with a stroke position thereof, said method comprising:

a step of striking the string set by the hammer in association with individual ones of different rest positions of the hammer, each of the different rest positions of the hammer corresponding to each of a plurality of stroke positions within one stroke of the pedal;

a detection step of, in response to the hammer striking the string set, detecting data indicative of at least one of behavior of the hammer and reaction of the string set, said detection step detecting the data in association with the individual ones of the plurality of stroke positions; and an identification step of identifying a half point of the pedal on a basis of the data detected by said detection step in association with the plurality of stroke positions.

12. An apparatus for identifying a half point of a pedal on a keyboard musical instrument, the keyboard musical instrument including: a key; a hammer constructed to make a pivotal motion in response to an operation of the key; and a string set comprised of at least one wire member and constructed to be struck by the hammer; and the pedal configured to make a stroke motion in response to a depressing operation performed thereon, the pedal being constructed to change a rest position of the hammer relative to the string set in accordance with a stroke position thereof, said apparatus comprising:

a sensor adapted to detect a plurality of stroke positions within one stroke of the pedal;

a detector adapted to, in response to the hammer striking the string set, detect data indicative of at least one of behavior of the hammer and reaction of the string set; and a processor adapted to:

for each of the plurality of stroke positions within one stroke of the pedal and in response to the hammer striking the string set from the rest position corresponding to the stroke position, detect the at least one of behavior of the hammer and reaction of the string set; and identify a half point of the pedal on a basis of the data detected in association with the plurality of stroke positions.

13. A method for reproducing a half point performance of a pedal on a keyboard musical instrument, the keyboard musical instrument including: a key; a hammer constructed to make a pivotal motion in response to an operation of the key; and a string set comprised of at least one wire member and constructed to be struck by the hammer; and the pedal configured to make a stroke motion in response to a depressing operation performed thereon, the pedal being constructed to change a rest position of the hammer relative to the string set in accordance with a stroke position thereof, said method comprising:

a step of providing a memory storing therein data identifying a half point of the pedal;

a step of striking the string set by the hammer in accordance with automatic performance data including at least data for driving the key; and a driving step of automatically driving the pedal in accordance with data included in the automatic performance data and instructing behavior of the pedal, said driving step positioning the pedal at a position of the half point stored in the memory when the data instructing the behavior of the pedal is indicative of an intermediate value of a depression depth of the pedal.

14. A non-transitory computer-readable storage medium storing a program executable by a processor to perform a method for reproducing a half point performance of a pedal on a keyboard musical instrument, the keyboard musical instrument a key; a hammer constructed to make a pivotal motion in response to an operation of the key; and a string set comprised of at least one wire member and constructed to be struck by the hammer; and the pedal configured to make a stroke motion in response to a depressing operation performed thereon, the pedal being constructed to change a rest position of the hammer relative to the string set in accordance with a stroke position thereof, said method comprising:

a step of striking the string set by the hammer in accordance with automatic performance data including at least data for driving the key; and a driving step of automatically driving the pedal in accordance with data included in the automatic performance data and instructing behavior of the pedal, said driving step acquiring the data identifying a half point of the pedal from a memory and positioning the pedal at a position of the acquired half point when the data instructing the behavior of the pedal is indicative of an intermediate value of a depression depth of the pedal, wherein said memory prestores therein the data identifying the half point of the pedal.

15. An apparatus for reproducing a half point performance of a pedal on a keyboard musical instrument, the keyboard musical instrument a key; a hammer constructed to make a pivotal motion in response to an operation of the key; and a string set comprised of at least one wire member and constructed to be struck by the hammer; and the pedal configured to make a stroke motion in response to a depressing operation performed thereon, the pedal being constructed to change a rest position of the hammer relative to the string set in accordance with a stroke position thereof, said apparatus comprising:

a memory storing therein data identifying a half point of the pedal;

a drive unit adapted to cause the hammer to strike the string set;

an actuator adapted to move the pedal; and a processor adapted to:

drive said drive unit in accordance with automatic performance data including at least data for driving the key so that said hammer strikes the string set; and automatically drive the pedal in accordance with data included in the automatic performance data and instructing behavior of the pedal, said processor positioning the pedal at a position of the half point stored in the memory when the data instructing the behavior of the pedal is indicative of an intermediate value of a depression depth of the pedal.

* * * * *